US007538639B2

(12) United States Patent
Mei

(10) Patent No.: US 7,538,639 B2
(45) Date of Patent: May 26, 2009

(54) LOW-PASS FILTER

(75) Inventor: Chia-Hao Mei, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 121 days.

(21) Appl. No.: 11/617,756

(22) Filed: Dec. 29, 2006

(65) Prior Publication Data

US 2008/0024247 A1 Jan. 31, 2008

(30) Foreign Application Priority Data

Jul. 28, 2006 (TW) ..... 95127770

(51) Int. Cl.
*H01P 1/20* (2006.01)
*H01P 3/08* (2006.01)

(52) U.S. Cl. ..... 333/202; 333/204

(58) Field of Classification Search ..... 333/202, 333/204, 176, 185

See application file for complete search history.

(56) References Cited

U.S. PATENT DOCUMENTS 7,098,759 B2 * 8/2006 Chang ..... 333/204
2006/0082424 A1 4/2006 Chang
2007/0216498 A1 * 9/2007 Chen ..... 333/204

FOREIGN PATENT DOCUMENTS

TW 200607229 2/2006

* cited by examiner

*Primary Examiner*—Daniel D Chang
(74) *Attorney, Agent, or Firm*—Wei Te Chung

(57) ABSTRACT

A filter includes an input portion, a low-impedance transmission portion, a high-impedance transmission portion, and an output portion. The input portion receives electromagnetic signals. The high-impedance transmission portion is electrically connected to the input portion, and includes a first high-impedance transmission portion, a second high-impedance transmission portion, a third high-impedance transmission portion, a first connection portion, and a second connection portion. The low-impedance transmission portion is electrically connected to the second high-impedance transmission portion, and includes a pair of protrusion portions. The output portion is electrically connected to the third high-impedance transmission portion, for outputting the electromagnetic signals therefrom. The first connection portion electrically connects the first high-impedance transmission portion to the second high-impedance transmission portion. The second connection portion electrically connects the second high-impedance transmission portion to the third high-impedance transmission portion.

20 Claims, 2 Drawing Sheets

LOW-PASS FILTER

BACKGROUND OF THE INVENTION

1. Field of the Invention

The invention generally relates to a filter, and particularly to a low-pass filter.

2. Description of Related Art

It is well-known that a filter is able to eliminate interference signals for a communication product. Features of an ideal filter are that signal attenuation is zero within a pass band and becomes infinite within a cut-off band, and a transition from the pass band to the cut-off band should be as sharp as possible, so that a distance between a transmission zero and the cut-off band is as short as possible. However, an unneglectable problem is, as the transmission zero and the cut-off band become closer, an insertion loss may correspondingly increase.

Therefore, a heretofore unaddressed need exists in the industry to overcome the aforementioned deficiencies and inadequacies.

SUMMARY OF THE INVENTION

A filter includes an input portion, a low-impedance transmission portion, a high-impedance transmission portion, and an output portion. The input portion receives electromagnetic signals. The high-impedance transmission portion is electrically connected to the input portion, and includes a first high-impedance transmission portion, a second high-impedance transmission portion, a third high-impedance transmission portion, a first connection portion, and a second connection portion. The low-impedance transmission portion is electrically connected to the second high-impedance transmission portion, and includes a pair of protrusion portions. The output portion is electrically connected to the third high-impedance transmission portion, for outputting the electromagnetic signals therefrom. The first connection portion electrically connects the first high-impedance transmission portion to the second high-impedance transmission portion. The second connection portion electrically connects the second high-impedance transmission portion to the third high-impedance transmission portion.

A filter includes an input portion, a high-impedance transmission portion, a low-impedance transmission portion, and an output portion. The input portion receives electromagnetic signals. The high-impedance transmission portion is electrically connected to the input portion, and includes a first high-impedance transmission portion, a second high-impedance transmission portion, and a third high-impedance transmission portion. The low-impedance transmission portion is electrically connected to the high-impedance transmission portion. The output portion is electrically connected to the second high-impedance transmission portion, for outputting the electromagnetic signals therefrom. The first high-impedance transmission portion, the second high-impedance transmission portion, and the third high-impedance transmission portion are electrically connected with each other.

Other advantages and novel features will become more apparent from the following detailed description when taken in conjunction with the accompanying drawings, in which:

DETAILED DESCRIPTION OF THE INVENTION

Figure 1:
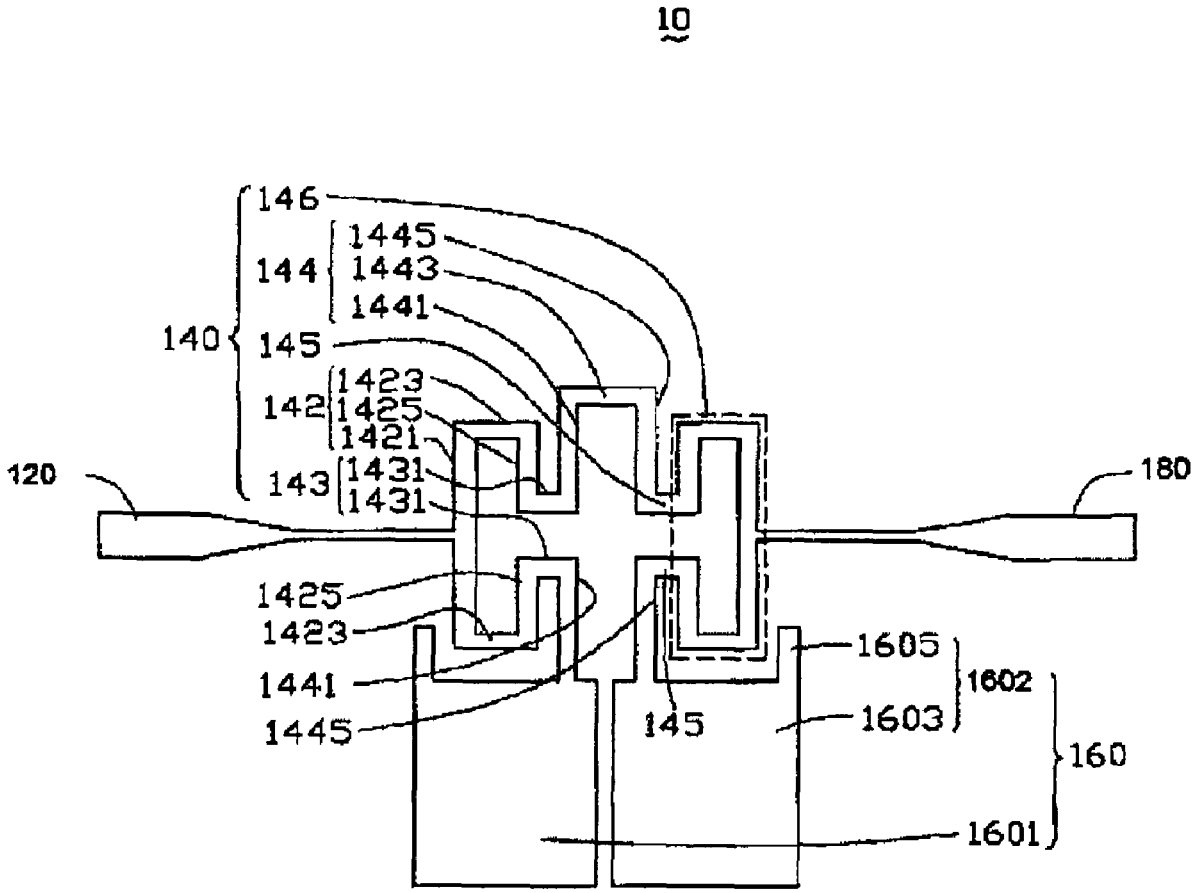
FIG. 1 is a schematic diagram of a filter of an exemplary embodiment of the invention.

FIG. 1 is a schematic diagram of a filter 10 of an exemplary embodiment of the invention.

The filter 10 includes an input portion 120, a high-impedance transmission portion 140, a low-impedance transmission portion 160, and an output portion 180. In this embodiment, the filter 10 is a low-pass filter, the high-impedance transmission portion 140 and the low-impedance transmission portion 160 may be equivalent to a series inductance and a parallel capacitance, respectively.

The input portion 120 receives electromagnetic signals. An imaginary connection line extends between the input portion 120 and the output portion 180 to divide the high-impedance transmission portion 140 into a first meander part and a second meander part at two opposite sides of the imaginary connection line, correspondingly.

The high-impedance transmission portion 140 is electrically connected to the input portion 120, and includes a first high-impedance transmission portion 142, a first connection portion 143, a second high-impedance transmission portion 144, a second connection portion 145, and a third high-impedance transmission portion 146. Each of the first and second meander part of the high-impedance transmission portion 140 comprises a half of the first high-impedance transmission portion 142, the first connection portion 143, the second connection portion 145, and a half of the third high-impedance transmission portion 146, respectively.

The first high-impedance transmission portion 142 includes a first high-impedance transmission line 1421, a pair of second high-impedance transmission lines 1423 parallel with each other, and a pair of third high-impedance transmission lines 1425.

The first high-impedance transmission line 1421 is electrically connected to the input portion 120, and is approximately perpendicular thereto. Ends of the first high-impedance transmission line 1421 are respectively connected to one end of each of the second high-impedance transmission lines 1423, and the first high-impedance transmission line 1421 is approximately perpendicular to the second high-impedance transmission lines 1423. The other ends of the second high-impedance transmission lines 1423 are respectively connected to ends of the third high-impedance transmission lines 1425. The third high-impedance transmission lines 1425 are parallel to the first high-impedance transmission line 1421, and are approximately perpendicular to the second high-impedance transmission lines 1423.

In this embodiment, widths of the first high-impedance transmission line 1421, the second high-impedance transmission lines 1423, and the third high-impedance transmission lines 1425 are approximately 0.2 millimeter (mm), and lengths thereof are 2 mm, 0.8 mm, and 0.9 mm, respectively. In other embodiments, lengths of the second high-impedance transmission lines 1423 may be different.

The first connection portion 143 includes a pair of first connection lines 1431 parallel to each other. One end of each of the first connection lines 1431 is connected to the other end of each of the third high-impedance transmission lines 1425. Lengths and widths of the first connection lines 1431 are respectively 0.2 mm and 0.6 mm.

The second high-impedance transmission portion 144 includes a pair of fourth high-impedance transmission lines 1441, a fifth high-impedance transmission line 1443, and a pair of sixth high-impedance transmission lines 1445. One end of each of the fourth high-impedance transmission lines 1441 is connected to the other end of each of the first connection lines 1431. One end of the fifth high-impedance transmission line 1443 is connected to the other end of one of the fourth high-impedance transmission lines 1441, and the fifth high-impedance transmission line 1443 is perpendicular to the fourth high-impedance transmission lines 1441. The other ends of the other high-impedance transmission lines 1441 are electrically connected to the low-impedance transmission portion 160. Shapes and sizes of the sixth high-impedance transmission lines 1445 are the same as those of the fourth high-impedance transmission lines 1441. The connection between the sixth high-impedance transmission lines 1445 and the fifth high-impedance transmission line 1443 is the same as that between the fourth high-impedance transmission lines 1441 and the fifth high-impedance transmission line 1443.

In this embodiment, widths of the fourth high-impedance transmission lines 1441 and the fifth high-impedance transmission line 1443 are 0.2 mm, and lengths thereof are 1.2 mm and 1 mm, respectively. In other embodiments, lengths of the fourth high-impedance transmission lines 1441 may be different.

A structure of the second connection portion 145 is the same as that of the first connection portion 143, and a connection between the second connection portion 145 and the second high-impedance transmission portion 144 is the same as that between the first connection portion 143 and the second high-impedance transmission portion 144.

The low-impedance transmission portion 160 includes a first low-impedance transmission portion 1601 and a second low-impedance transmission portion 1602. In this embodiment, a structure of the first low-impedance transmission portion 1601 is the same as that of the second low-impedance transmission portion 1602. The first low-impedance transmission portion 1601 is connected to the fourth high-impedance transmission line 1441, and the second low-impedance transmission portion 1602 is connected to one of the sixth high-impedance transmission lines 1445.

The first low-impedance transmission portion 1601 includes a rectangular low-impedance transmission line 1603 and a protrusion portion 1605. The protrusion portion 1605 is extended from the low-impedance transmission line 1603, and is approximately parallel to the sixth high-impedance transmission lines 1445. Lengths of the low-impedance transmission line 1603 and the protrusion portion 1605 are respectively 2.9 mm and 0.6 mm, and widths thereof are respectively 1.8 mm and 0.2 mm.

The output portion 180 is electrically connected to the third high-impedance transmission portion 146, for outputting the electromagnetic signals therefrom. In this embodiment, shapes and sizes of the output portion 180 are the same as those of the input portion 120.

Figure 2:
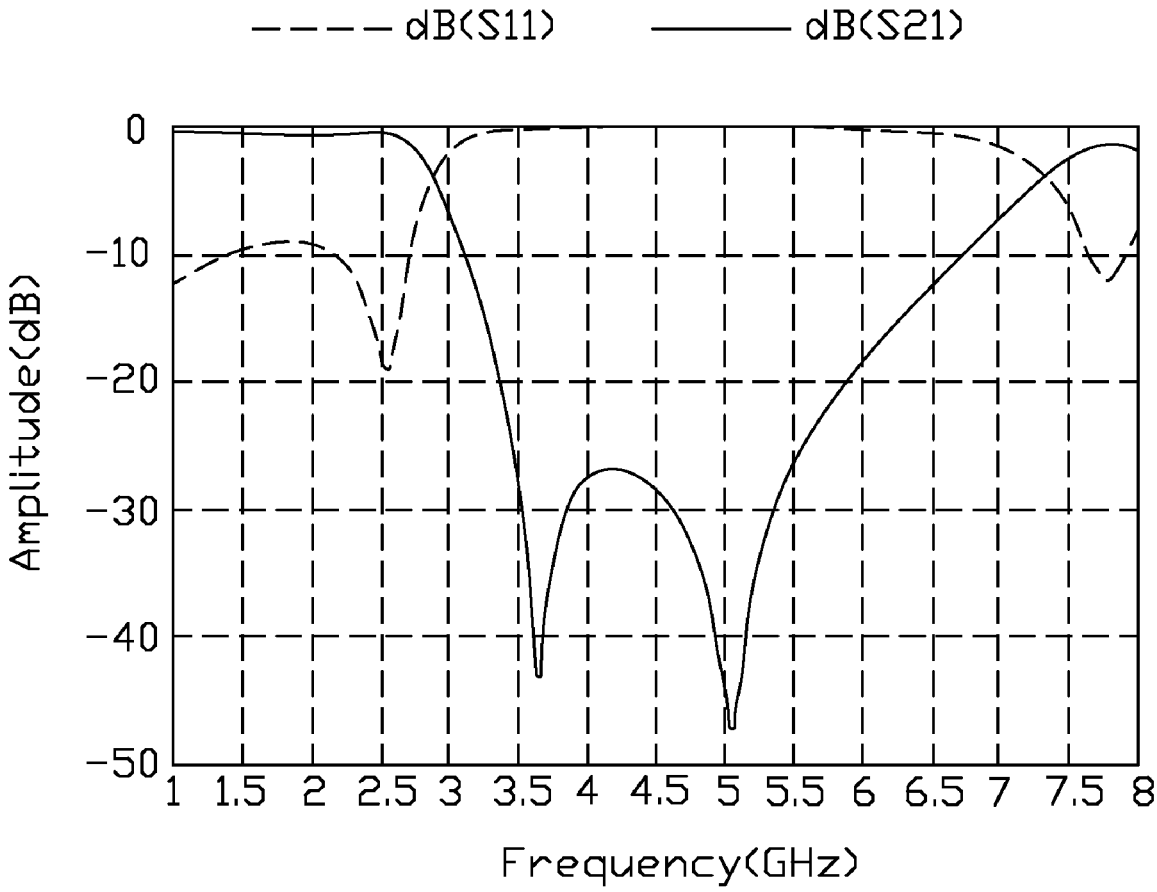
FIG. 2 is a graph showing a relationship between amplitudes of insertion and return loss and frequencies of electromagnetic signals traveling through the filter.

FIG. 2 is a graph showing a relationship between amplitudes of insertion and return loss and frequencies of electromagnetic signals traveling through the filter.

In FIG. 2, the insertion loss is represented by a solid line S21, and the return loss is represented by a broken line S11. The curve S21 indicates a relationship between a value of an input power and a value of an output power of the electromagnetic signals traveling through the filter 10, and is represented by the following equation:

$$S21=-10*\text{Log}\ [(\text{Input Power})/(\text{Output Power})].$$

When the electromagnetic signals travel through the filter 10, a part of the input power is returned to a source of the electromagnetic signals. The part of the input power returned to the source of the electromagnetic signals is called a return power. The curve S11 indicates a relationship between the input power and the return power of the electromagnetic signals traveling through the filter 10, and is represented by the following equation:

$$S11=-10*\text{Log}\ [(\text{Input Power})/(\text{Return Power})].$$

For a filter, when a value of an output power of electromagnetic signals in a band-pass frequency range approaches a value of an input power thereof, and a return power of the electromagnetic signals is small, it means that a distortion of the electromagnetic signals is small and a performance of the filter 10 is good. That is, the smaller an absolute value of the insertion loss is, and the greater the absolute value of the return loss is, the better the performance of the filter is.

As shown in FIG. 2, the filter 10 has a good performance as a low-pass filter. The absolute value of the insertion loss approaches a value of 0, and the absolute value of the return loss is greater than a value of 10.

What is claimed is:

1. A filter, comprising:

an input portion for receiving electromagnetic signals;

a high-impedance transmission portion electrically connected to the input portion, and including a first high-impedance transmission portion, a second high-impedance transmission portion, a third high-impedance transmission portion, a first connection portion, and a second connection portion, wherein the first connection portion comprises a pair of high-impedance transmission lines for electrically connecting the first high-impedance transmission portion and the second high-impedance transmission portion;

a low-impedance transmission portion electrically connected to the second high-impedance transmission portion, and including a pair of protrusion portions; and an output portion electrically connected to the third high-impedance transmission portion, for outputting the electromagnetic signals therefrom;

wherein the second connection portion electrically connects the second high-impedance transmission portion to the third high-impedance transmission portion.

2. The filter in accordance with claim 1, wherein the first high-impedance transmission portion comprises a first high-impedance transmission line, a pair of second high-impedance transmission lines parallel to each other, and a pair of third high-impedance transmission lines parallel to the first high-impedance transmission line.

3. The filter in accordance with claim 2, wherein each end of the first high-impedance transmission portion is connected to one end of each of the second high-impedance transmission portions respectively.

4. The filter in accordance with claim 3, wherein the first high-impedance transmission line is approximately perpendicular to the second high-impedance transmission line.

5. The filter in accordance with claim 4, wherein one end of each of the third high-impedance transmission lines is connected to the other end of each of the second high-impedance transmission lines respectively.

6. The filter in accordance with claim 2, wherein the second high-impedance transmission portion comprises a pair of fourth high-impedance transmission lines, a fifth high-impedance transmission line, and a pair of sixth high-impedance transmission lines, the fourth high-impedance transmission lines are approximately perpendicular to the fifth high-impedance transmission line, one of the fourth high-impedance transmission lines electrically is connected to the fifth high-impedance transmission line, and sizes and shapes of the sixth high-impedance transmission lines are the same as those of the fourth high-impedance transmission lines.

7. The filter in accordance with claim 6, wherein a structure of the second connection portion is the same as that of the first connection portion, the first connection portion and the second connection portion are respectively located at both sides of the second high-impedance transmission portion, and a connection between the second connection portion and the second high-impedance transmission portion is the same as that between the first connection portion and the second high-impedance transmission portion.

8. The filter in accordance with claim 1, wherein a structure of the third high-impedance transmission portion is the same as that of the first high-impedance transmission portion, and the first high-impedance transmission portion and the third high-impedance transmission portion are respectively located at both sides of the second high-impedance transmission portion.

9. The filter in accordance with claim 1, wherein the low-impedance transmission portion further comprises a first low-impedance transmission portion and a second low-impedance transmission portion, a structure of the first low-impedance transmission portion being the same as that of the second low-impedance transmission portion.

10. The filter in accordance with claim 9, wherein the first low-impedance transmission portion comprises a low-impedance transmission line and a protrusion portion, the protrusion portion extending from the low-impedance transmission line.

11. The filter in accordance with claim 10, wherein the protrusion portion is rectangular.

12. A filter, comprising:

an input portion for receiving electromagnetic signals;

a high-impedance transmission portion being electrically connected to the input portion, and including a first high-impedance transmission portion, a second high-impedance transmission portion, and a third high-impedance transmission portion, wherein the first high-impedance transmission portion comprises a first high-impedance transmission line, a pair of second high-impedance transmission lines parallel to each other, and a pair of third high-impedance transmission lines parallel to the first high-impedance transmission line;

a low-impedance transmission portion electrically connected to the high-impedance transmission portion;

an output portion electrically connected to the third high-impedance transmission portion, for outputting the electromagnetic signals therefrom;

wherein the first high-impedance transmission portion, the second high-impedance transmission portion, and the third high-impedance transmission portion are electrically connected with each other.

13. The filter in accordance with claim 12, wherein the first high-impedance transmission portion, the second high-impedance transmission portion, and the third high-impedance transmission portion are approximately rectangular frames.

14. The filter in accordance with claim 13, wherein a structure of the first high-impedance transmission portion is the same as that of the third high-impedance transmission portion, the first high-impedance transmission portion and the third high-impedance transmission portion respectively located at both sides of the second high-impedance transmission portion.

15. The filter in accordance with claim 12, wherein the low-impedance transmission portion further comprises a first low-impedance transmission portion and a second low-impedance transmission portion, a structure of the first low-impedance transmission portion being the same as that of the second low-impedance transmission portion.

16. The filter in accordance with claim 15, wherein the first low-impedance transmission portion comprises a low-impedance transmission line and a protrusion portion, the protrusion portion extending from the low-impedance transmission line.

17. A filter comprising:

an input portion for receiving electromagnetic signals into said filter;

an output portion spaced from said input portion for outputting said electromagnetic signals out of said filter;

a high-impedance transmission portion electrically connectable between said input portion and said output portion for treating said electromagnetic signals through said filter, said high-impedance transmission portion comprising a first meander part extending at a first side of an imaginary connection line between defined to imaginatively straightly connect said input portion with said output portion, and a second meander part extending at a second side of said imaginary connection line opposite to said first side thereof; and a low-impedance transmission portion disposed at said second side of said imaginary connection line and electrically connectable with said second meander part of said high-impedance transmission portion.

18. The filter in accordance with claim 17, wherein said low-impedance transmission portion comprises a protrusion portion extending perpendicularly out of said low-impedance transmission portion so that said second meander part of said high-impedance transmission portion immediately neighbors said protrusion portion at a first side of said second meander part and immediately neighbors said low-impedance transmission portion at a second side of said second meander part different from said first side thereof.

19. The filter in accordance with claim 17, wherein said second meander part of said high impedance transmission portion is substantially symmetric to said first meander part relative to said imaginary connection line except connections of said second meander part with said low-impedance transmission portion.

20. The filter in accordance with claim 17, wherein a section of said first meander part and a section of said second meander part cooperatively form a first high-impedance transmission portion, said first high-impedance transmission portion is electrically connected to said input portion and comprises a first high-impedance transmission line, a pair of second high-impedance transmission lines perpendicularly electrically connected to said first high-impedance transmission line and parallel to each other, and a pair of third high-impedance transmission tines parallel to said first high-impedance transmission line and respectively electrically connected to said pair of second high-impedance transmission lines.

* * * * *